US008438750B2

(12) United States Patent
Dittmer et al.

(10) Patent No.: US 8,438,750 B2
(45) Date of Patent: May 14, 2013

(54) DRYER HAVING A LINT FILTER AND A CLEANING DEVICE

(75) Inventors: Lothar Dittmer, Berlin (DE); Klaus Grunert, Berlin (DE); Thomas Nawrot, Berlin (DE); Andreas Ziemann, Potsdam (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 291 days.

(21) Appl. No.: 13/063,222

(22) PCT Filed: Sep. 2, 2009

(86) PCT No.: PCT/EP2009/061329

§ 371 (c)(1),
(2), (4) Date: Mar. 10, 2011

(87) PCT Pub. No.: WO2010/028992

PCT Pub. Date: Mar. 18, 2010

(65) Prior Publication Data

US 2011/0167662 A1 Jul. 14, 2011

(30) Foreign Application Priority Data

Sep. 11, 2008 (DE) ..... 10 2008 041 998

(51) Int. Cl.
*F26B 11/02* (2006.01)

(52) U.S. Cl.
USPC ..... 34/83; 34/602; 34/610; 68/19.1; 68/20; 8/149.2; 8/159; 134/10; 134/42

(58) Field of Classification Search ..... 34/82, 83, 34/602, 606, 609, 610; 55/385.1, 385.4, 55/491; 68/5 C, 19.1, 20; 84/471 SR; 438/5; 428/196, 219, 221; 8/158, 159, 149.2; 15/347; 134/1, 10, 42
See application file for complete search history.

(56) References Cited

U.S. PATENT DOCUMENTS 2,612,705 A * 10/1952 Kauffman ..... 34/85
2,828,550 A * 4/1958 Geldhof ..... 34/75
3,256,613 A * 6/1966 Moulthrop ..... 34/402
3,405,452 A * 10/1968 Candor et al. ..... 34/251
4,653,200 A * 3/1987 Werner ..... 34/82

(Continued)

FOREIGN PATENT DOCUMENTS

DE 102006018469 A1 10/2007
DE 102009002389 A1 * 10/2010

(Continued)

*Primary Examiner* — Stephen M. Gravini
(74) *Attorney, Agent, or Firm* — James E. Howard; Andre Pallapies

(57) ABSTRACT

A dryer has a drying chamber to receive damp items and a process air duct to feed process air into and extract process air out of the drying chamber. The process air duct has a heat source and a heat sink to heat the process air before the process air enters the drying chamber and to cool the process air after the process air leaves the drying chamber, respectively. A cleaning device has an accumulator for a liquid; a rinsing line connected to the accumulator; a control organ in the rinsing line; a distributor connected to the rinsing line to distribute the liquid conveyed through the rinsing line on a lint filter and to receive the lint caught by the lint filter; and a drain line to drain the liquid with the received lint away from the lint filter and towards the accumulator.

11 Claims, 3 Drawing Sheets

U.S. PATENT DOCUMENTS

| | | | | |
|---|---|---|---|---|
| 5,042,170 | A * | 8/1991 | Hauch et al. | 34/82 |
| 5,226,203 | A * | 7/1993 | Sacconato et al. | 8/159 |
| 7,766,988 | B2 * | 8/2010 | Roberts | 55/385.1 |
| 7,805,856 | B2 | 10/2010 | Gassmann et al. | |
| 7,886,458 | B2 * | 2/2011 | Blair | 34/83 |
| 7,913,415 | B2 | 3/2011 | Goldberg et al. | |
| 7,946,054 | B2 * | 5/2011 | Dittmer et al. | 34/63 |
| 8,001,701 | B2 * | 8/2011 | Goldberg et al. | 34/82 |
| 8,307,567 | B2 * | 11/2012 | Han et al. | 34/73 |
| 2004/0216326 | A1 * | 11/2004 | Kitamura et al. | 34/597 |
| 2004/0221474 | A1 * | 11/2004 | Slutsky et al. | 34/319 |
| 2007/0108181 | A1 | 5/2007 | Gassmann et al. | |
| 2008/0235977 | A1 * | 10/2008 | Kuwabara | 34/77 |
| 2008/0282569 | A1 | 11/2008 | Roberts | |
| 2008/0307667 | A1 * | 12/2008 | Ikemizu | 34/132 |
| 2010/0146809 | A1 * | 6/2010 | Grunert et al. | 34/443 |
| 2011/0167662 | A1 * | 7/2011 | Dittmer et al. | 34/82 |

FOREIGN PATENT DOCUMENTS

| | | | | |
|---|---|---|---|---|
| EP | 1936022 | A1 | | 6/2008 |
| FR | 2664625 | A1 | | 1/1992 |
| GB | 2300700 | A | | 11/1996 |
| JP | 06178897 | A | * | 6/1994 |
| JP | 06190196 | A | * | 7/1994 |
| JP | 07178290 | A | * | 7/1995 |

* cited by examiner

DRYER HAVING A LINT FILTER AND A CLEANING DEVICE

BACKGROUND OF THE INVENTION

The invention relates to a dryer comprising a drying chamber to accommodate damp items to be dried and an essentially closed process air duct to circulate process air through the drying chamber, said process air duct having a heat source for heating the process air before its entry into the drying chamber and a heat sink for cooling the process air after it leaves the drying chamber, as well as a first lint filter arranged between the drying chamber and the heat source to which a first cleaning device is assigned.

A dryer for drying washing by means of an air flow is known from publications EP 1 788 140 A1, EP 1 788 141 A2 and EP 1 788 142 A2. In the dryer a mesh filter for filtering lint out of the air flow is arranged in the area of the end shield in the process air duct, with said mesh forming a first lint filter. A squeegee is used to wipe off the lint collected in the process air duct by the filter and store it in a container adjacent to the squeegee and to the filter. Together with further components, the squeegee and the container thus form a first cleaning device. However, the space available in the area of the squeegee for accommodating it means that the container is dimensioned relatively small. Lint from around 7 to 10 drying processes can be collected therein. Since the lint is stored in the dry state it occupies a relatively large volume. On the one hand the accessibility to the accumulation container is restricted during this drying and on the other hand the accumulation volume is limited by the fact that it is disposed in a restricted-space zone of the dryer, which results in maintenance to remove the lint from the container having to be undertaken at relatively frequent intervals. The dryer also has a heater as a heat source and an air-air heat exchanger as a heat sink in the process air duct.

BRIEF SUMMARY OF THE INVENTION

The object of the present invention is to specify a generic dryer in which the removal of lint from the lint filter by means of the first cleaning device is further improved and in which it is possible to further extend the intervals at which a user has to dispose of the accumulated lint.

This object is achieved by a generic dryer which has the features of the independent claim. Preferred developments emerge in particular from the dependent claims and preferred combinations of developments, especially from corresponding combinations of dependent claims.

The inventive dryer comprising a drying chamber for accommodating damp items to be dried and a process air duct for feeding process air into the process chamber and for venting process air from the drying chamber, with the process air duct especially being a substantially closed process air duct for circulating process air through the drying chamber, with said process air duct having a heat source for heating up the process air before it enters the drying chamber and a heat sink for cooling the process air after it leaves the drying chamber, as well as a first lint filter arranged between the drying chamber and the heat sink to which a first cleaning device is assigned, is characterized in that the first cleaning device comprises an accumulator for the liquid, a first rinsing line connected to the accumulator, a first control organ located in this first rinsing line and a first distributor connected to the first rinsing line for distributing liquid conveyed through the first rinsing line onto the first lint filter and for accepting lint caught by the first lint filter and a first drain line for draining the liquid with the caught lint from the first lint filter into the accumulator.

Thus, in accordance with the invention, the lint is rinsed off the first lint filter by the latter being rinsed by a suitable liquid, which is preferably condensate which has occurred and been collected in the dryer, and the lint is thus taken up by the liquid and can be drained away with the latter. This does away with the previously unavoidable dry and dust-generating scraping of the lint filter and there is no longer any need for the previously usual disposal of the dry lint. By contrast, the effect of the liquid is to cause the rinsed-off lint to be taken up by said liquid, or to be caught in an additional filter and separated from the liquid, forming relatively compact moist lumps which can be disposed of very easily and without forming further dust.

In a preferred embodiment of the inventive dryer the first drain line has a second lint filter for catching the trapped lint. The first lint filter catches the vast majority of all lint which occurs during a drying process in the dryer and all this lint is transferred into the liquid. The second lint filter can capture this lint and thus provides said lint separated from the liquid as a relatively compact, easily-removable body for any type of disposal.

In another preferred development of the inventive dryer the first lint filter has a filter material attached to a carrier, with the filter material having at least one property of the group comprising the properties hydrophobicized, dirt-repellent and antibacterial. Especially preferred in such cases is a filter material which is hydrophobicized. All said properties can be imparted to the filter material by a corresponding coating, with the coating able to be formed in a manner known per se by impregnation or plasma coating.

In another preferred development of the inventive dryer the accumulator is assigned to the heat sink for collecting condensate which precipitates in the heat sink from the process air. The accumulator in this case does not necessarily have to be located in the vicinity of the heat sink; in accordance with general practice the accumulator can in particular be one that is removable from the dryer and is placed at a point conveniently accessible to a user at a distance from the heat sink. The user can then remove the accumulator from the dryer at the end of the drying process and dispose of the condensate collected therein; in this context it is also possible to dispose of the lint caught in the (appropriately placed) second lint filter. In this particular case it is especially preferred for a pump line and also condensate pump to be provided in the corresponding dryer which connects the heat sink with the accumulator. The pump line can especially extend from a collection tray placed on the heat sink in which condensate accumulates which has formed in the heat sink from the process air flow being cooled down and has precipitated on the heat sink and drips off the latter. The collection tray can in this case be an integrated component of that part of the process air duct in which the heat sink is placed.

The generic versions and embodiments of heat source and heat sink in the inventive dryer are not of primary importance; basically heat source and heat sink of any known generic type and embodiment are conceivable and useful in conjunction with the invention. In particular the heat source can be a heater operated electrically or by combustion of a suitable fuel such as oil and gas. In particular the heat sink can be a heat exchanger operated with a suitable coolant, for example an air-air heat exchanger.

Especially preferred is a development of the inventive dryer in which the heat source and the heat sink belong to a heat pump, with said heat pump being configured to pump heat from the heat sink to the heat source. In such cases it is preferred for the corresponding dryer to have a second cleaning device which comprises a second rinsing line connected to the accumulator, a second control organ located in the second rinsing line and a second distributor connected to the second rinsing line for distributing the liquid conveyed through the second rinsing line to the heat sink. In a dryer equipped with a heat pump of no matter what type, heat which is supplied to the process air by the heat source and is removed from the process air in the heat sink is fed back to the heat source again and is supplied by this once more to the process air, from which a significant saving in energy for the drying process in the dryer can be obtained. In particular when the heat pump is a thermoelectric heat pump or heat pump of the compressor type, in accordance with conventional practice the heat sink must be permanently connected to further components of the heat pump and cannot be removed from the dryer like a conventional air-air heat exchanger for the purposes of cleaning. It is then especially sensible to assign to the heat sink a second cleaning device through which the heat sink can have lint which was not able to be caught by the first lint filter and which has adhered to it cleaned from it. If this second cleaning device also operates with liquid, then in an especially advantageous manner, it can be combined with the first cleaning device as is described here.

In accordance with another preferred development the inventive dryer is configured as a tumble dryer for drying a damp item of laundry. In this case it is further preferred for the drying chamber to be a rotatable drum.

It is also especially preferred for the inventive dryer to be embodied as a household appliance.

BRIEF DESCRIPTION OF THE DRAWINGS

Exemplary embodiments of the invention will be explained in greater detail below on the basis of the drawing. The drawing shows.

DETAILED DESCRIPTION OF EXEMPLARY EMBODIMENTS OF THE PRESENT INVENTION

Figure 1:
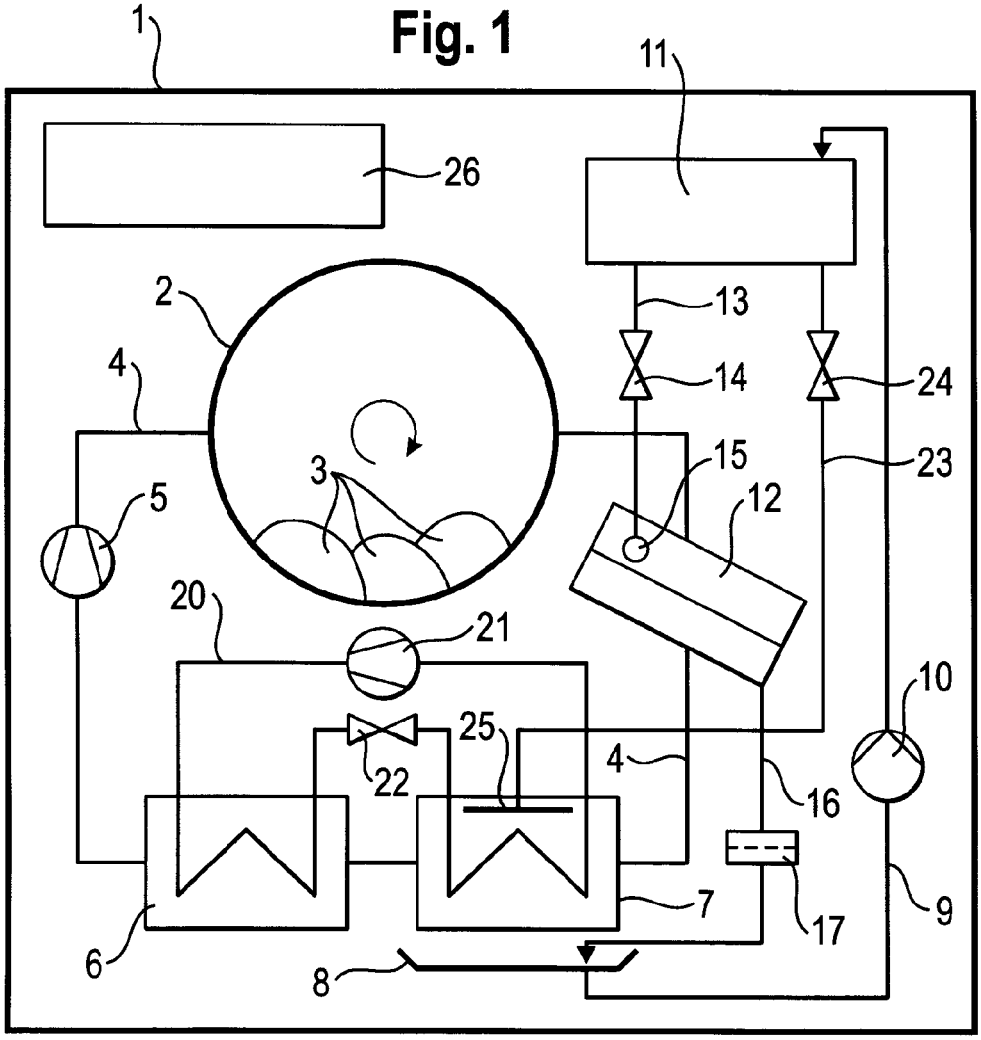
FIG. 1 a diagram of a household appliance designed as a tumble dryer.

As shown in FIG. 1, the dryer 1, in this case a tumble dryer 1, comprises a drying chamber 2 designed as a rotatable drum which accepts damp items 3, in this case laundry 3, for drying. For the dryer 1 shown in FIG. 1 a closed process air duct 4 is provided in which a process air flow circulates, driven by a fan 5, which accepts moisture from the laundry 3 and takes it away. In a heat source 6 the process air is heated up before its entry into the drying chamber 2. After the process air heated up in this way, as a result of the rotation of the drying chamber 2, has flowed around laundry 3 falling down in said chamber while taking up moisture therefrom, it leaves the drying chamber 2 and arrives at a heat sink 7. Here it is cooled so that the moisture that it carries with it condenses out, precipitates as condensate in liquid form on the structures of the heat sink 7 and drips down into a collection tray 8 arranged below the heat sink. From the collection tray 8 such condensate travels via the pump line 9 into which a condensate pump 10 is inserted, to an accumulator 11. This accumulator 11 is designed so that after a drying process has ended, it can be removed from the dryer 1 to enable the liquid to be pored out of it and taken away for disposal in a suitable manner.

Between the drying chamber 2 and the heat sink 7 a first lint filter 12 is arranged in the process air duct 4. This first lint filter 12 is necessary to catch lint, which is fine dust-like fiber particles and the like which the flowing process air tears away from the laundry 3, so that said lint does not reach the heat sink 7 and contaminate it. This is above all required because lint, which settles on correspondingly exposed surfaces of the heat sink 7, can significantly worsen the thermal conductivity of the structures within the heat sink 7, so that the operation of the dryer 1 is adversely effected and can even be endangered. However even the presence of the first lint filter 12 in the process air duct 4 is not free of possible adverse effects since the first lint filter 12 also represents under some circumstances a substantial obstacle to the flow in the process air duct 4 if it attracts lint during the course of a drying process.

In order to avoid these adverse effects and also to create a practical option for removal of the lint from the dryer 1, the first lint filter 12 is assigned a first cleaning device 13, 1, 15, 16, 17, with which the first lint filter 12 is able to the freed from lint using the condensate stored in the accumulator 11. For this purpose a first rinsing line 13 is connected to the accumulator 11 which runs via a first control organ 14 to a first distributor 15 arranged on the first of lint filter 12 through which condensate can be distributed from the accumulator over the first lint filter 12 so that this condensate takes up and removes lint deposited on the first lint filter 12. Such condensate charged with lint passes through a first drain line 16 to a second lint filter 17 which catches the lint taken up by the condensate, at which point the condensate again flows into the collection tray 8 in order to be conveyed from this by means of the condensate pump 10 back to the accumulator 11. In the second lint filter 17 the lint is present as compact, moist lumps which can be removed and disposed of comparatively easily from the second lint filter. The condensate in the accumulator 11 remains free of lint to a certain extent so that it can be used in a known manner in place of distilled water, for example for ironing laundry. In an alternate version of the dryer 1 not shown, the accumulator 11 can be filled exclusively or additionally with fresh water taken from a domestic water supply. This makes it possible to ensure that the accumulator 11 always contains the required quantity of liquid necessary for cleaning the lint filter 12.

The heat source 6 and the heat sink 7 are incorporated in the exemplary embodiment shown here into a heat pump 6, 7, 20, 21, 22 in which heat which is removed from the process air in the heat sink 7, is pumped to the heat source 6 and is fed back into the process air there. A closed coolant circuit 20 in which a coolant circulates is used for this purpose. A coolant is to be understood as a substance able to be reversibly evaporated and condensed under suitable conditions with respect to pressure and temperature. In the present example this substance can be propane, carbon dioxide or a fluorinated hydrocarbon compound such as the R134a, R152a, R470C and R410a—with the last two substances mentioned being mixtures of a number of fluorinated hydrocarbons. In any event the coolant in the coolant circuit 20 arrives at the heat sink 7 in liquid form, where it evaporates while taking up heat from the of process air also flowing through the heat sink. A compressor 21 in the coolant circuit 20 compresses the evaporated coolant and conveys it to the heat source 6. There the coolant liquefied while emitting heat to the process air flowing through the duct. In liquid form the coolant now flows in the coolant circuit 20 to a choke 22, represented by a valve, a capillary tube or a diaphragm, where it is expanded to a lowered pressure. In this form it arrives back at the heat sink 7 in order to evaporate there again. The coolant circuit 20 must be entirely self-contained in order to guarantee complete enclosure the coolant over the expected operational life of the dryer 1.

In practice the first lint filter 12 is not able to take up all of the lint carried along by the process air; there is always the possibility of even an extremely fine-grain fraction of the lint getting through the lint filter 12 without being caught by it. This fine-grain lint then precipitates more or less completely in the heat sink 7, with the condensate occurring there allowing it to adhere to the correspondingly exposed surfaces of the heat sink 7. This lint, possibly over a larger number of drying processes in the dryer 1, can have a significant adverse effect on the function of the heat sink 7. In the present case another difficulty is that, because of the complete sealing of the coolant circuit 20 called for, it is not possible to take the heat sink 7 out of the dryer 1 for the purposes of cleaning it. Therefore the heat sink 7 is assigned a second cleaning device 23, 24, 25 with which the condensate collected in the accumulator 11 can also be used in order to rinse off the surfaces of the heat sink 7 subjected to the process air and remove the lint arising. For this purpose a second rinsing line 23 along with an inserted second control organ 24 is assigned to the accumulator which connects the accumulator 11 to a second distributor 25 placed on the heat sink 7. Via this second distributor 2 condensate arrives at the heat sink 7 from the accumulator 11 and can rinse off the lint that has settled there. The condensate loaded with lint in this way drips off into the collection tray 8 and is fed from there by means of the condensate pump 10 back to the accumulator 11 again. Since the first lint filter 12 catches almost all lint, the heat sink 7 is subjected to comparatively little stress and the lint which settles on it is relatively fine-grained. Accordingly there is no danger of this lint for example being able to adversely affect the pump line or the condensate pump or also the further usability of the condensate collected in the accumulator 11.

The control organs 14 and 24 are each shown here as simple valves 14 or 24. In the event of a relatively strong flow of condensate being required for the corresponding cleaning purposes, a pump can also be provided in addition to each such valve 14 or 24. If necessary a single pump could also be assigned to the two valves 14 or 24.

A control device 26 is provided in the dryer 1. This is used by a user of the dryer for selecting a program from a plurality of programs offered for the required drying process, contains a display device in order to provide the user with the necessary information and also controls all controllable components of the dryer 1. To make the diagram clearer the corresponding control lines are not shown in FIG. 1.

Figure 2:
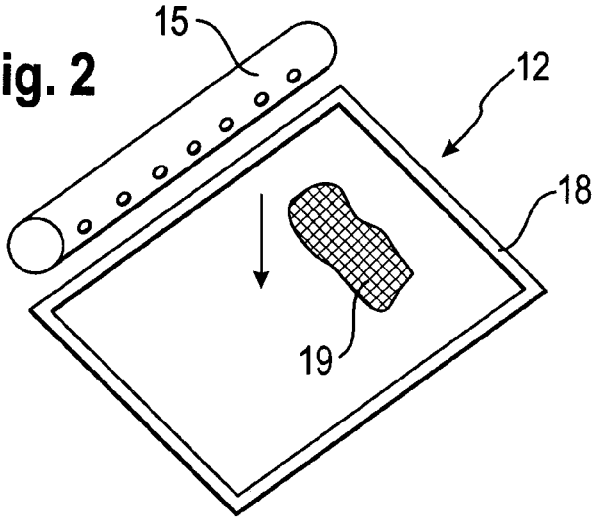
FIG. 2 a first lint filter along with a first distributor for rinsing liquid.

FIG. 2 shows a first lint filter 12 which is constructed with a carrier 18 which carries a filter material 19. Process air flows in the direction of the arrow through the filter material 19, with lint contained therein being deposited on the filter material 19. The filter material 19 consists of a surface-treated material which is equipped to repel water or contamination. This supports the cleaning effect of the liquid which flows over the filter material 19 without passing through it while taking up the lint from the filter material 19. Also shown is the distributor arranged on the first lint filter 12 from which the condensate used for rinsing can escape through a plurality of holes in order to flow over the filter material 19 and take up the lint deposited there. In any case it would not be critical if a part of the liquid were to penetrate through the filter material 19, since (cf. FIG. 1) the lint filter 12 is followed in the process air duct 4 in any event by the heat sink 7 in which condensate drops out of the processed airflow and any liquid which might have penetrated the material would be taken away together with the condensate. FIG. 2 shows circular holes; as an alternative to the holes a slot of an appropriate length or an arrangement of a number of longitudinal slots lying behind one another can be provided.

Figure 3:
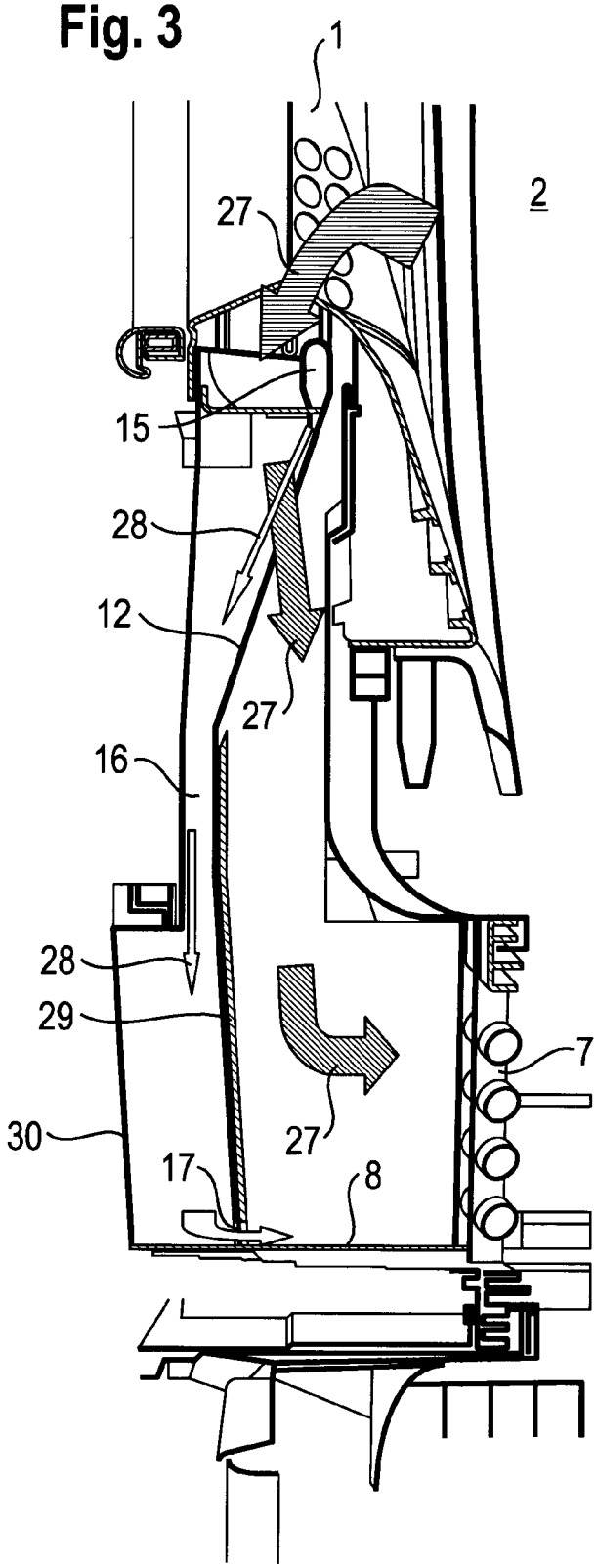
FIG. 3 a part sectional view of a tumble dryer.

FIG. 3 shows a part of the dryer 1 as a sectional view. The diagram shows a section through the front shield plate of the dryer 1 which is adjoined by the drying chamber 2, see reference character 2. The process air symbolized by black arrows leaves the drying chamber 2 from the top right and flows through the first lint filter 12 placed obliquely relative to it in a direction vertically downwards in order to arrive after a diversion into a horizontal direction at the heat sink 7. From the first distributor 15 only partly visible in the figure, condensate flows as rinsing water 28 over the obliquely placed lint filter 12, whereby it takes up the lint deposited there and passes through a first drain line 16 into a chamber which is formed by a removable flap 30 and a partition wall 29. In a lower area the partition wall 29 is permeable so that the rinse water can pass through it and reach the collection tray 8 so that the lint is retained in the lower area of the chamber. The chamber is removable so that the lint can be disposed of.

Figure 4:
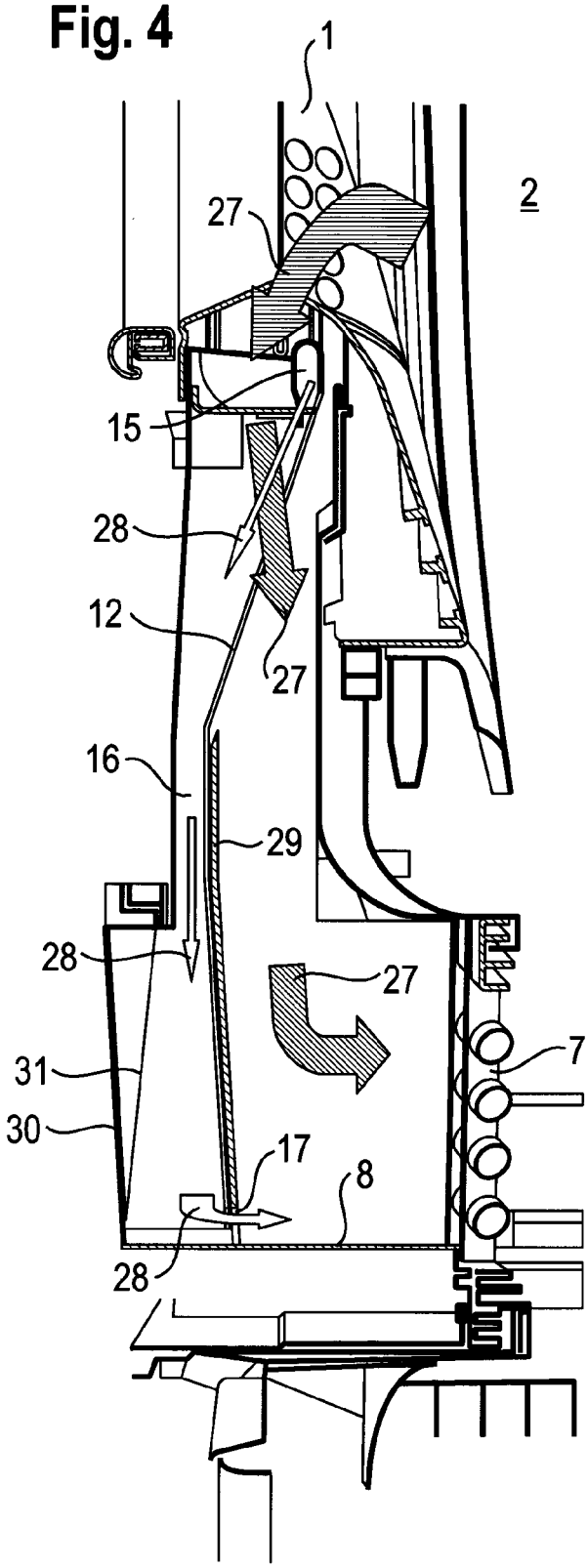
FIG. 4 a part sectional view of another tumble dryer.

The embodiment of the dryer 1 shown in FIG. 4 largely corresponds to the embodiment according to FIG. 3, with a filter bag 31 being provided behind the flap 30 however. This filter bag 31 is made of permeable paper or textile and accepts the lint rinsed off the lint filter 12 by means of the rinsing water 28. When the filter bag 31 has been suitably filled with such lint it can be removed by opening the flap 30. This enables the lint to be disposed of without it having to be touched directly.

The invention creates a new option for disposing of the lint necessarily occurring in a dryer for laundry or the like in such a way as to largely prevent any adverse effects on each drying process and with the lint being put into a compact form especially suitable for disposal. This dryer is therefore characterized by being especially easy to use.

The invention can also be employed in a dryer which has an open process air duct 4 as is usual with so-called vented air dryers, i.e. the process air is taken from the room air surrounding the dryer, fed to the drying chamber 2 and the process air extracted from the drying chamber 2 is output back into the room air. Otherwise this dryer likewise comprises the devices included in the dryer 1 shown here.

LIST OF REFERENCE CHARACTERS

1. Dryer
2. Drying chamber
3. Moist items, laundry
4. Process air duct
5. Fan
6. Heat source
7. Heat sink
8. Collecting tray
9. Pump line
10. Condensate pump
11. First cleaning device, accumulator
12. First lint filter
13. First cleaning device, first rinsing line
14. First cleaning device, first control organ
15. First cleaning device, first distributor
16. First cleaning device, first drain line
17. First cleaning device, second lint filter
18. Carrier
19. Filter material
20. Coolant circuit
21. Compressor
22. Choke

23. Second rinsing line
24. Second control organ
25. Second distributor
26. Control device
27. Process air
28. Rinsing water
29. Partition wall
30. Flap
31. Filter bag

The invention claimed is:

1. A dryer, comprising:

a drying chamber to receive damp items;

a process air duct to feed process air into the drying chamber and to extract process air from the drying chamber, the process air duct having a heat source to heat the process air before the process air enters the drying chamber and a heat sink to cool the process air after the process air leaves the drying chamber;

a first lint filter between the drying chamber and the heat sink to catch lint from the process air; and a first cleaning device assigned to the first lint filter, the first cleaning device having:

an accumulator for a liquid;

a first rinsing line connected to the accumulator;

a first control organ in the first rinsing line;

a first distributor connected to the first rinsing line to distribute the liquid, which is conveyed through the first rinsing line, on the first lint filter and to receive the lint caught by the first lint filter; and a first drain line to drain the liquid with the received lint away from the first lint filter and towards the accumulator.

2. The dryer of claim 1, wherein the process air duct is a substantially closed process air duct to circulate the process air through the drying chamber.

3. The dryer of claim 1, wherein the first drainage line has a second lint filter to catch the received lint.

4. The dryer of claim 1, wherein the first lint filter has a filter material attached to a carrier, wherein the filter material is at least one of hydrophobicized, contamination-repellent, and antibacterial.

5. The dryer of claim 1, wherein the accumulator is assigned to the heat sink to catch condensate which falls out from the process air in the heat sink.

6. The dryer of claim 5, further comprising a condensate pump and a pump line, the pump line to connect the heat sink to the accumulator.

7. The dryer of claim 1, further comprising a heat pump, wherein the heat source and the heat sink are associated with the heat pump, and wherein the heat pump is configured to pump heat from the heat sink to the heat source.

8. The dryer of claim 7, further comprising a second cleaning device, the second cleaning device having:

a second rinsing line connected to the accumulator;

a second control organ in the second rinsing line; and a second distributor connected to the second rinsing line to distribute the liquid conveyed through the second rinsing line to the heat sink.

9. The dryer of claim 1, wherein the dryer is a tumble dryer to dry moist laundry items.

10. The dryer of claim 9, wherein the drying chamber is a rotatable drum.

11. The dryer of claim 9, wherein the dryer is a household appliance.

* * * * *